United States Patent [19]

Franklin

[11] Patent Number: 4,827,459

[45] Date of Patent: May 2, 1989

[54] HIGH SENSITIVITY ACCELEROMETER FOR CROSSED DIPOLES ACOUSTIC SENSORS

[75] Inventor: J. B. Franklin, Dartmouth, Canada

[73] Assignee: Her Majesty the Queen in right of Canada, as represented by the Minister of National Defence of Her Majesty's Canadian Government, Canada

[21] Appl. No.: 125,328

[22] Filed: Nov. 25, 1987

[30] Foreign Application Priority Data

Dec. 15, 1986 [CA] Canada ..... 525382

[51] Int. Cl.[4] ..... H04R 17/00

[52] U.S. Cl. ..... 367/158; 367/159; 310/337

[58] Field of Search ..... 367/155, 157, 158, 159, 367/163, 164, 165; 310/322, 325, 334, 337, 338, 328; 73/721, 727

[56] References Cited

U.S. PATENT DOCUMENTS

| | | | |
|---|---|---|---|
| 3,311,873 | 3/1967 | Schloss | 310/337 |
| 4,446,544 | 5/1984 | Connoll, Jr. | 367/155 |
| 4,546,459 | 10/1985 | Congdon | 367/155 |

FOREIGN PATENT DOCUMENTS

| | | | |
|---|---|---|---|
| 1008554 | 12/1977 | Canada | 367/159 |

*Primary Examiner*—Brian S. Steinberger
*Attorney, Agent, or Firm*—Larson and Taylor

[57] ABSTRACT

An accelerometer for underwater acoustic sensors includes a pair of cylindrical piezoelectric crystals configured in a cantilever mode and having attached thereto an electrode segmented into four equal quadrants. In response to translational motion perpendicular to the axes of the piezoelectric crystals, orthogonal voltage signals are generated, from which the crossed dipole directivity patterns can be obtained. The symmetric use of two such piezoelectric crystals enables spurious responses, to rotational motion about an axis perpendicular to the central axis of a cylindrical container for the crystals, to be avoided.

10 Claims, 2 Drawing Sheets

HIGH SENSITIVITY ACCELEROMETER FOR CROSSED DIPOLES ACOUSTIC SENSORS

FIELD OF THE INVENTION

The present invention relates to accelerometers for underwater acoustic sensors.

BACKGROUND OF THE INVENTION

There is a requirement to provide directivity in small inexpensive underwater acoustic sensor assemblies suitable for use in sonobuoys and towed arrays. In sonobuoys, such a device is required to provide target-bearing information; in towed arrays, the device is needed to provide a means for resolving the left-right ambiguity inherent in a line of omnidirectional sensors. One of the simplest directional hydrophones consists of a dipole hydrophone in combination with a monopole hydrophone. The dipole hydrophone senses a (horizontal) vector component of the acoustic field (velocity, acceleration or pressure gradient), and the monopole hydrophone senses a scalar component (pressure). The two signals are added, with appropriate phase and amplitude adjustment, to form right-facing and left-facing cardioid directivity patterns:

$$P(\theta,\phi)=P[1+\sin(\theta)\sin(\phi)]$$

$$P(\theta,\phi)=P[1-\sin(\theta)\sin(\phi)]$$

where $\theta$ is the angle from the vertical, $\phi$ is the azimuth angle, and P is a reference amplitude.

A crossed dipole sensor for underwater acoustics measurements can be realized using pressure gradient hydrophone arrays, or particle velocity sensors. The use of pressure gradient hydrophones, or arrays of such hydrophones, is based on the principle of obtaining the first order spatial derivative by taking the difference between the outputs of two closely spaced omnidirectional hydrophones. The effectiveness of such devices may, however, be unacceptable at lower frequencies due to channel imbalances in phase and amplitude. In addition thereto, the pressure gradient hydrophone may have to be of considerable size if operation at low frequencies is required.

The particle velocity sensor offers an alternative to the pressure gradient sensor and, although it provides reduced control over sensitivity, it eliminates the channel imbalance problem. The particle velocity sensor concept can be realized by mounting an accelerometer in a container (preferably one which is neutrally buoyant) having dimensions which are small compared to an acoustic wavelength and without resonances in the frequency band of interest. Satisfactory designs for the particle velocity sensor have been obtained using moving coil accelerometers and piezoelectric bender elements. However, the particle velocity sensor may be unacceptable at low frequencies if the sensitivity of the accelerometer is not high enough to overcome the self-generated noise problem.

In addition to the above, problems have been encountered in trying to devise sensors with sufficient sensitivity to overcome self-generated noise at the lowest frequency of interest and with sufficiently wide bandwidth to process signals at the highest frequency of interest. Some accelerometer designs which provide adequate sensitivity for low frequency operation can introduce a device resonance in the listening bandwidth. In particular, known bender element designs exhibit an in-band resonance which can be expected to introduce channel imbalance in phase and amplitude from sensor to sensor in the vicinity of this resonance. An in-band resonance is objectionable because the frequency response of the sensor must be accurately known to permit effective combination of the particle velocity sensor signals with the signal from an omnidirectional hydrophone. Furthermore, this channel imbalance can be expected to be troublesome if beamforming applications with a number of such sensors are specified. The moving coil accelerometer referred to above is inherently expensive and may also exhibit an in-band resonance.

Thus, there is a need for a simple inexpensive accelerometer with sufficient sensitivity for acceptable low frequency operation and with the device resonance above the frequency range of interest; the frequency range of interest for some applications may extend over nine octaves. The crossed dipole sensor embodied in the invention will have a differential output, as opposed to a single-ended output, and its electrical impendance will essentially be capacitive, but it does not matter which vector component of the sound field is detected, as this merely affects the phase and amplitude adjustment of the signals before they are added together.

SUMMARY OF THE INVENTION

The present invention relates to an accelerometer for underwater acoustic sensors which includes a pair of cylindrical piezoelectric crystals configured in a cantilever mode and having attached thereto an electrode segmented into four equal quadrants. In response to translational motion perpendicular to the axes of the piezoelectric crystals, orthogonal voltage signals are generated, from which the crossed dipole directivity patterns can be obtained. The symmetric use of two such crystals enables spurious responses, due to rotational motion about an axis perpendicular to the central axis of a cylindrical container for the crystals, to be avoided.

More particularly, the present invention relates to an accelerometer for an underwater acoustic sensor, comprising a pair of substantially cylindrical piezoelectric crystals, each of the cylindrical crystals being affixed at the proximal end thereof to means for supporting the crystal; and means for detecting voltage signals from each of four substantially equal quadrants of each of the piezoelectric crystals, whereby the signals from each pair of diagonally opposite quadrants are reinforced and the resulting orthogonal signals provide an indication of directivity.

BRIEF DESCRIPTION OF THE DRAWINGS

A preferred embodiment of the present invention will now be described in conjunction with the attached drawings, in which.

DETAILED DESCRIPTION OF THE PREFERRED EMBODIMENT

Figure 1:
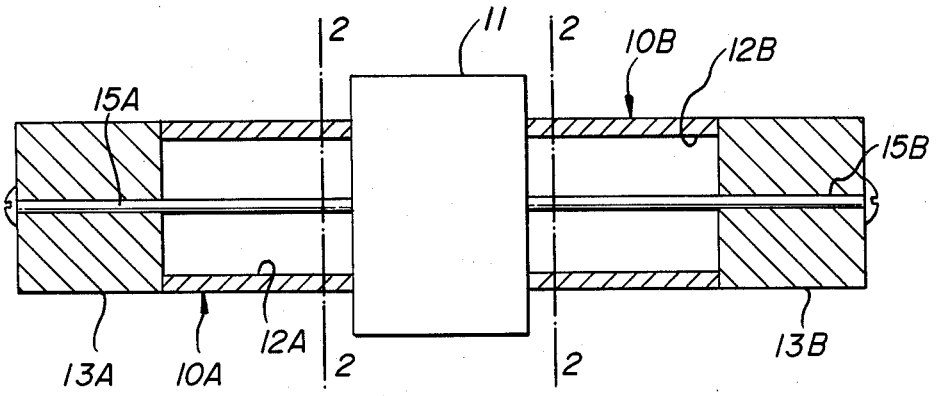
FIG. 1 depicts a pair of cylindrical piezoelectric crystals configured in the cantilever mode of the present invention.

As depicted in FIG. 1, a pair of cylindrical piezoelectric crystals 10, shown in the Figures as 10A and 10B, are configured in a cantilever mode, whereby the proximal ends of each of crystals 10A and 10B are affixed to a central platform 11. When crystals 10 are subjected to translational motion perpendicular to their axes, bending stresses are developed in their cylinder walls 12 shown in FIG. 1 as 12A and 12B. As will be described below, a suitable arrangement of electrodes provides orthogonal voltage signals from the voltages produced in the piezoelectric material by these stresses, from which the crossed dipole directivity patterns can be obtained.

Figure 2:
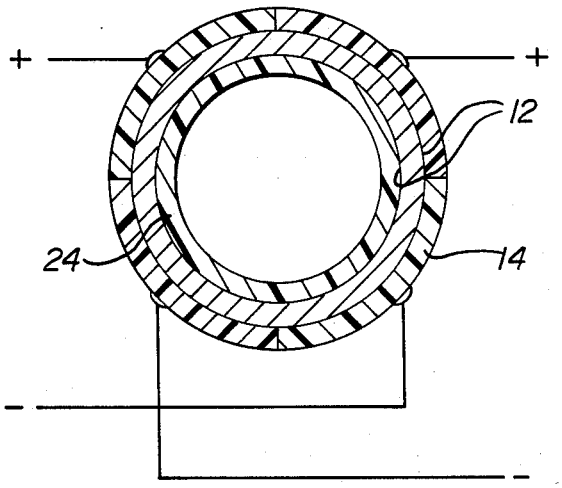
FIG. 2 depicts an enlarged cross-sectional view of a piezoelectric crystal of FIG. 1, taken along either of the lines 2—2 of FIG. 1, with parts behind the plane of lines 2—2 omitted, illustrating an arrangement of electrodes for detecting the voltage signals therefrom.

As depicted in the cross-sectional view of FIG. 2, each of piezoelectric crystals 10A and 10B has attached, to its wall 12A, 12B respectively, electrodes 14 and 24 for detecting the voltage signals produced by crystals 10. (FIG. 2 is not drawn to scale, the thickness of electrodes 14 and 24 being exaggerated for clarity.) Either inner electrode 24 or outer electrode 14B of crystals 10A and 10B is segmented into quadrants to provide the orthogonal signals necessary to effect crossed dipoles operation from a single piezoelectric crystal, it usually being easier to segment the outer electrode 14 (as herewith depicted). The segmentation is also required to permit signal reinforcement from opposite quadrants, as also seen from FIG. 2; this follows from the fact that the stresses on opposite sides of crystals 10 subjected to bending are of opposite sign. this electrode arrangement also provides for a balanced output from each channel, as well as the provision of a center tap which may be used if external electrical circuit considerations so require. Note that if outer electrode 14 is segmented, as shown in FIG. 2, inner electrode 24 is continuous and, if required by the external circuit configuration, can be connected thereto.

The sensitivity and device resonance are controlled in part by a mass loading 13 on that end of each of crystals 10 which is not attached to platform 11. A pair of stress bolts 15, shown as 15A and 15B, coincident with the central axes of crystals 10, is used to improve the shock resistance of the sensor and to increase the sensitivity of the device, stress bolts 15 affixing mass loadings 13 to platform 11 without significantly adding to the bending stiffness of crystals 10.

Figure 3:
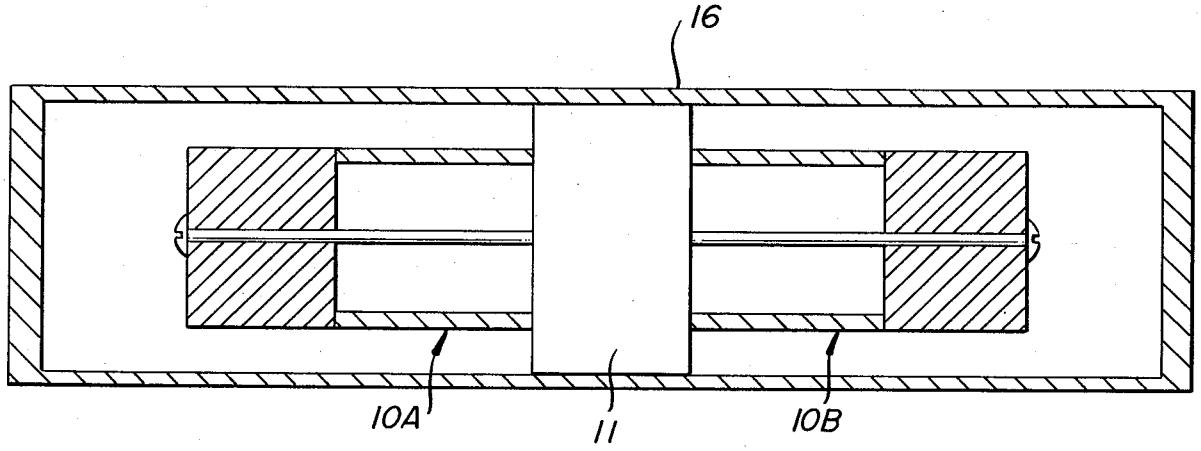
FIG. 3 depicts a cylindrical container for the piezoelectric crystals of FIG. 1.

The accelerometer herein described is appropriate for mounting in a cylindrical container 16, as depicted in FIG. 3, and is therefore well suited to the towed array application referred to above; the symmetric arrangement of two such piezoelectric crystals is used in those applications where spurious responses to rotations of the sensor assembly may prove troublesome. The size of cylindrical container 16 can be selected to provide an acoustic radiation impedance corresponding to a relatively low and predictable Q at this natural frequency. In some environments (eg, those with high electrical noise), it may be advantageous to segment inner electrode 24 and 'ground' continuous outer electrode 14.

The use of a single crystal 10A in the configuration described above permits the device to be mounted on a planar surface; in this application, it can be used to measure the two components of planar motion of that surface.

An example of an accelerometer, configured in accordance with the arrangement depicted in FIG. 3, had each of piezoelectric crystals 10A and 10B consisting of a small cylinder made of PZT-5A and being 12.7 mm long by 0.75 mm thick by 12.7 mm in diameter. End masses 13, made of steel, were 12.7 mm long and 12.7 mm in diameter. Masses 13 were drilled to permit the use of a 10/32 stress bolt 15, being 4.1 mm in diameter. The measured sensitivity of each crystal 10A and 10B was 0.28 volts per g of acceleration (0.0286 volts per m/sec$^2$). Crystals 10 were mounted on either side of aluminum mounting plate 11 and connected electrically in parallel. The natural frequency of this accelerometer was found to be 3700 Hz. The dimensions of aluminum container 16 were chosen to avoid resonances in the frequency band of interest (5–1000 Hz) and to achieve neutral buoyancy in sea water; the diameter and wall thickness of container 16 were 3.18 cm and 0.16 cm, respectively, and the length of container 16 was either 20 cm or 10.2 cm.

The foregoing has shown and described a particular embodiment of the invention, and variations thereof will be obvious to one skilled in the art. Accordingly, the embodiment is to be taken as illustrative rather than limitative, and the true scope of the invention is as set out in the appended claims.

The embodiments of the invention in which an exclusive property or privilege is claimed are defined as follows:

1. An accelerometer for an underwater acoustic sensor, comprising:

a pair of substantially cylindrical piezoelectric crystals, each of said crystals being affixed at proximal ends to a support means and extending outwardly from said support means as a cantilever beam, said crystals and said support means being mounted in an enclosed container which isolates the crystals from the pressure of the medium surrounding the container, means for detecting voltage signals generated by bending stresses in four substantially equal quadrants of each crystal when said crystals are subjected to accelerations perpendicular to the axis of said crystals, and wherein the combined voltage signals from each pair of diagonally opposite quadrants provide resultant signals which are a measure of the two orthogonal components of planar motion of a surface on which the accelerator is mounted.

2. An accelerometer according to claim 1, wherein said support means comprises a platform arranged substantially perpendicular with respect to the axes of the said pair of piezoelectric crystals.

3. An accelerometer according to claim 1, further including an end mass at the distal end of each of said crystals, wherein the inertial forces generated by said end masses produce bending stresses in the crystals.

4. An accelerometer according to claim 3, further comprising a pair of stress bolts coincident with the central axes of said crystals and securing said end masses to the distal ends of said crystals, wherein the inertial forces generated by said bolts produce large bending stresses in the crystals.

5. An accelerometer according to claim 1, wherein said container has a neutral buoyancy relative to a surrounding water medium.

6. An accelerometer according to claim 1, wherein said means for detecting voltage signals comprises a segmented outer electrode.

7. An accelerometer according to claim 1, wherein said means for detecting voltage signals comprises a segmented inner electrode.

8. An accelerometer for an underwater acoustic sensor, comprising:

a substantially cylindrical piezoelectric crystal, which is affixed at a first end to a support means and extends outwardly from said support means as a cantilever beam, said crystal and said support means being mounted in an enclosed container which isolates the crystal from the pressures of the medium surrounding the container, means for detecting voltage signals generated by bending stresses in four substantially equal quadrants of said crystal when said crystal is subjected to accelerations perpendicular to its axis, the combined voltage signals from each pair of diagonally opposite quadrants providing resultant signals which are a measure of the two orthogonal components of planar motion of a surface on which the accelerometer is mounted.

9. An accelerometer according to claim 8, comprising an end mass at the other end of said piezoelectric crystal, wherein the inertial forces generated by said end mass produces large bending stresses in said crystal.

10. An accelerometer according to claim 9, further comprising a stress bolt coincident with the central axis of said crystal and securing said end mass to said other end of the crystal, wherein the inertial forces generated by said end mass produces large bending stresses in the crystal.

* * * * *